US006397863B1

(12) United States Patent
Cadima

(10) Patent No.: US 6,397,863 B1
(45) Date of Patent: Jun. 4, 2002

(54) METHOD AND APPARATUS FOR COUPLING A RACK TO A DISHWASHER

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,390

(22) Filed: Aug. 29, 2001

(51) Int. Cl.[7] ..... B08B 3/02

(52) U.S. Cl. ..... 134/25.2; 134/135; 134/201; 312/332; 312/334.1

(58) Field of Search ..... 134/57 D, 56 D, 134/58 D, 135, 201, 25.2; 312/332, 334.1, 334.8

(56) References Cited

U.S. PATENT DOCUMENTS 2,143,039 A * 1/1939 Stoddard
2,633,399 A * 3/1953 Haas
3,044,842 A * 7/1962 Abresch et al.
3,072,452 A * 1/1963 Sleeper
3,321,161 A * 5/1967 Guth
3,466,105 A * 9/1969 Guth
3,560,069 A * 2/1971 Doepke
3,913,998 A * 10/1975 Vander Ley
4,019,794 A * 4/1977 Rowe
4,226,490 A 10/1980 Jenkins et al.
4,303,286 A * 12/1981 McClellan
4,449,765 A 5/1984 Lampman
5,409,309 A 4/1995 Giddings et al.
5,671,986 A 9/1997 Vinet
5,787,911 A 8/1998 Jacobus et al.

* cited by examiner

*Primary Examiner*—Frankie L. Stinson
(74) *Attorney, Agent, or Firm*—Armstrong Teasdale LLP

(57) ABSTRACT

A rack assembly is described for a dishwasher. The rack assembly has a centerline extending from a front of the dishwasher to a rear of the dishwasher. The rack assembly includes a rack, roller assembly, and a mounting system. The rack has a front edge and a rear edge connected by a right side edge and a left side edge. The rack also has a centerline extending from the rack front edge to the rack rear edge. The roller assembly rotatably couples the rack to the dishwasher such that the rack is slidably moveable with respect to the dishwasher. The mounting system is coupled to the rack and is slidably coupled to the roller assembly. The mounting system is configured to remain coupled to the roller assembly during movement of the rack when the rack centerline is skewed relative to the rack assembly centerline.

35 Claims, 3 Drawing Sheets

METHOD AND APPARATUS FOR COUPLING A RACK TO A DISHWASHER

BACKGROUND OF THE INVENTION

This invention relates generally to dishwashers and, more particularly to racks for dishwashers.

At least some known dishwashers include a cabinet that has an access door hinged at its lower end and is pivotable to open outwardly from the cabinet. The cabinet includes a wash chamber, and lower and upper racks are vertically mounted within the wash chamber.

The upper racks are slidably coupled to the cabinet and as such, are inwardly and outwardly moveable with respect to the cabinet along a fixed line of movement. More specifically, the upper racks are attached to rollers which are positioned within drawer guides mounted within the cabinet. The drawer guides define the direction of movement for the rack and also limit an amount of lateral orientation of the rack during its movement. If the rack is skewed with respect to the cabinet, the rack may bind against the drawer guides during movement. The drawer guides limit a degree of skew the rack may have with respect to the cabinet during movement of the rack.

The drawer guides also define a clearance between the rollers and the guides to facilitate free movement of the rollers. These clearances, however, may also cause looseness between the rollers and the drawer guide, and thus, may actually facilitate the rack becoming skewed during the movement. When the rack becomes skewed, the rollers may become misaligned with the drawer guide, and a relatively tight frictional drag induced between the rollers and the drawer guide may cause the rack to bind in its relative position. Such misalignment may also cause an increase in an amount of effort required to move the rack.

Additionally, in some known dishwashing machines, the rollers are fabricated from plastic and the drawer guides are formed from rolled steel. Sharp steel edges that may have been created when the drawer guides were formed from rolled steel may catch on the rollers. Binding between the rollers and these sharp steel edges may cause an increase in the amount of effort required to move the rack and may damage the rollers.

SUMMARY OF INVENTION

In one aspect, a rack assembly for a dishwasher is provided. The rack assembly has a centerline extending from a front of the dishwasher to a rear of the dishwasher. The rack assembly includes a rack, a roller assembly, and a mounting system. The rack has a front edge and a rear edge connected by a right side edge and a left side edge. The rack also has a centerline extending from the rack front edge to the rack rear edge. The roller assembly rotatably couples the rack to the dishwasher such that the rack is slidably moveable with respect to the dishwasher. The mounting system is coupled to the rack and slidably coupled to the roller assembly. The mounting system is configured to remain coupled to the roller assembly during movement of the rack when the rack centerline is skewed relative to the rack assembly centerline.

In another aspect, a dishwasher including a cabinet, a tub, a guide assembly, and at least one rack assembly is provided. The cabinet includes an access door having an upper end and a lower end. The lower end is hinged such that the door pivots on a substantially horizontal axis to open outwardly from the cabinet. The tub is positioned within the cabinet and forms a wash chamber. The tub includes right and left sidewalls. The guide assembly is secured to the right and left sidewalls of the tub. At least one rack assembly is positioned within the wash chamber and is moveable relative to the tub. The rack assembly has a centerline extending from a front of the dishwasher to a rear of the dishwasher. The rack assembly includes a rack, a roller assembly, and a mounting system. The rack has a front edge, a rear edge, a right side edge, a left side edge, and a centerline. The rack front and rear edges are connected by the rack left and right side edges. The rack right side edge is adjacent to the right tub sidewall and the rack left side edge is adjacent to the left tub sidewall. The rack has a centerline extending from the rack front edge to the rack rear edge. The roller assembly rotatably couples the rack to the guide assembly such that the rack is slidably moveable with respect to the wash chamber. The mounting system is coupled to the rack and slidably coupled to the roller assembly. The mounting system is configured to remain coupled to the roller assembly during movement of the rack when the rack centerline is skewed relative to the rack assembly centerline.

In another aspect, a method for assembling a rack assembly for a dishwasher is provided. The rack assembly has a centerline extending from a front of the dishwasher to a rear of the dishwasher. The method employs a rack, a roller assembly, and a mounting system. The rack has a front edge and a rear edge connected by a right side edge and a left side edge. The rack also has a centerline extending from the rack front edge to the rack rear edge. The roller assembly rotatably couples the rack to the dishwasher such that the rack is slidably moveable with respect to the dishwasher. The method includes the steps of providing the rack, coupling the roller assembly to the rack, coupling the mounting system to the rack and to the roller assembly, and rotatably coupling the roller assembly to the dishwasher such that the rack is moveable with respect to the dishwasher and such that the mounting system remains slidably coupled to the roller assembly during movement of the rack when the rack centerline is skewed relative to the rack assembly centerline.

DETAILED DESCRIPTION

Figure 1:
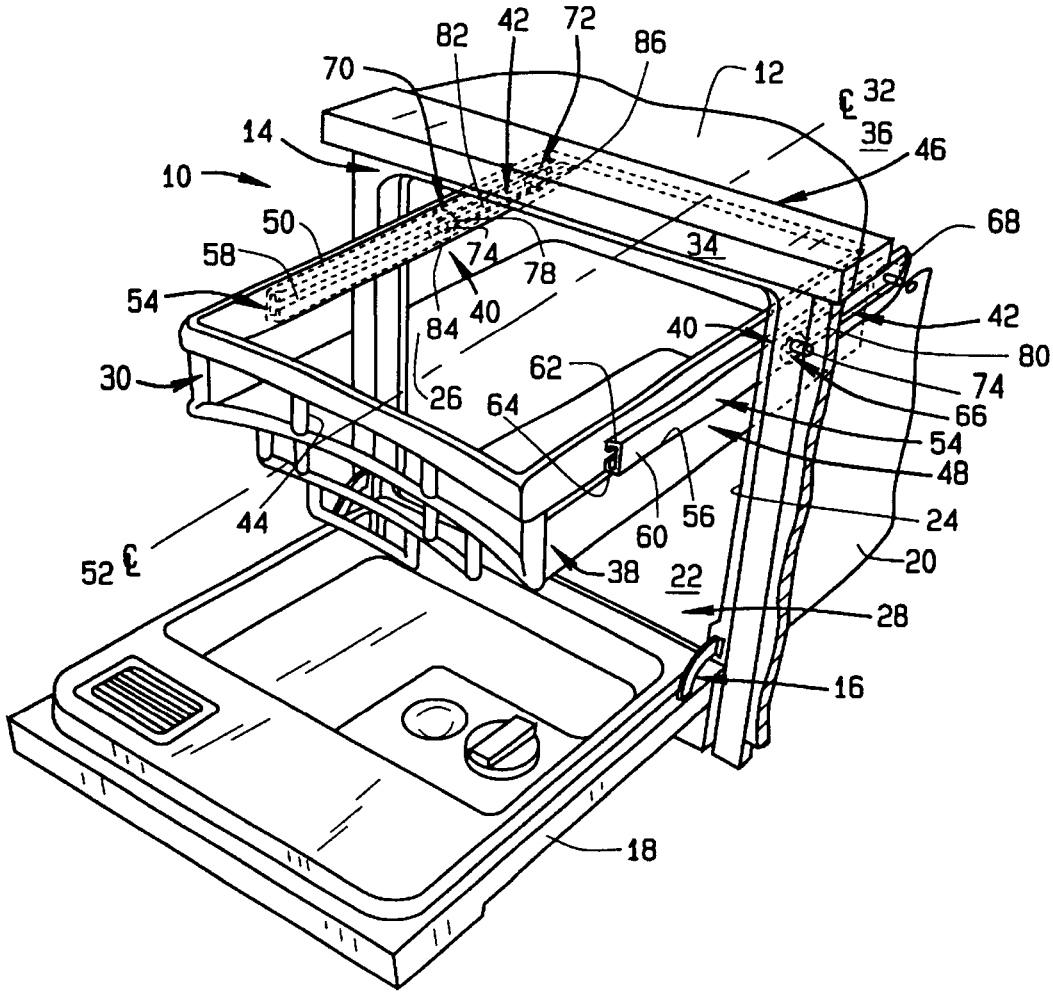
FIG. 1 is a side elevational view of a front loading dishwasher having a portion of the cabinet side wall cut away to show an upper rack and support structure within the wash chamber.

FIG. 1 is a side elevational view of a front loading dishwasher. Dishwasher 10 includes a cabinet 12 having an upper end 14, a lower end 16, and an access door 18. Access door 18 is hinged at lower end 16 and pivotable on a horizontal axis to open outwardly from cabinet 12. A tub 20 is positioned within cabinet 12 and forms a wash chamber 22. Tub 20 includes right and left sidewalls 24 and 26, respectively, and an access opening 28. Access door 18 is hinged to swing downwardly away from access opening 28. Dishwasher 10 may, for example, be model number GSD-5930DWW, commercially available from General Electric Company, Appliance Park, Louisville, Ky. 40225, and modified to include an upper rack assembly 30. Upper rack assembly 30 has a centerline 32 that extends from a front 34 of dishwasher 10 to a rear 36 of dishwasher 10. Rack assembly 30 includes a rack 38, a roller assembly 40, and a mounting system 42.

Specifically, upper rack 38 is vertically positioned within wash chamber 22 and is slidable relative to tub 20 such that upper rack 38 can be slidably withdrawn from and re-inserted within access opening 28. Upper rack 38 has a front edge 44, a rear edge 46, a right side edge 48, a left side edge 50, and a centerline 52. Rack front and rear edges 44 and 46, respectively, are connected by rack right and left side edges 48 and 50, respectively. Rack centerline 52 extends from rack front edge 44 to rack rear edge 46.

Roller assembly 40 rotatably couples rack 38 to a guide assembly 54 mounted within dishwasher 10. More specifically, rack 38 is slidably moveable inwardly and outwardly with respect to wash chamber 22 by roller assembly 40. Guide assembly 54 includes a first elongated channel member 56 secured to right tub sidewall 24 and a second elongated channel member 58 secured to left tub sidewall 26. Each channel member 56 and 58 includes a body portion 60, and upper and lower projecting flange portions 62 and 64, respectively. Upper flange portion 62 and lower flange portion 64 project from body portion 60 and converge towards each other.

Roller assembly 40 includes a right front roller 66 positioned on rack right side edge 48 in close proximity to rack front edge 44, a right rear roller 68 positioned on rack right side edge 48 in close proximity to rack rear edge 46, a left front roller 70 positioned on rack left side edge 50 in close proximity to rack front edge 44, and a left rear roller 72 positioned on rack left side edge 50 in close proximity to rack rear edge 46. Right front roller 66 and right rear roller 68 are positioned within guide assembly channel 56 and are substantially aligned with guide assembly channel 56. Left front roller 70 and left rear roller 72 are positioned within guide assembly channel 58 and are substantially aligned within guide assembly channel 58. Each respective roller 66, 68, 70, and 72 has a hub 74 that has a diameter 76 (not shown in FIG. 1). Each roller 66, 68, 70, and 72 also includes a bore 78 that extends therethrough. In the exemplary embodiment, each bore 78 is substantially smooth.

Mounting system 42 is coupled to rack 38 and is slidably coupled to roller assembly 40 such that mounting system 42 remains coupled to roller assembly 40 during movement of rack 38 with respect to wash chamber 22. More specifically, mounting system 42 remains coupled to roller assembly 40 when rack centerline 52 is skewed relative to rack assembly centerline 32. Mounting system 42 includes a right axle 80 that is coupled to rack right side edge 48 and extends substantially parallel to rack right side edge 48, and a left axle 82 that is coupled to rack left side edge 50 and extends substantially parallel to rack left side edge 50. Each axle 80 and 82 has a front slide 84 that is in close proximity to rack front edge 44, and a rear slide 86 that is in close proximity to rack rear edge 46. Each front slide 84 extends from each respective axle 80 and 82, and slidably couples to respective front rollers 66 and 70. Each rear slide 86 extends from respective axle 80 and 82 and slidably couples to respective rear rollers 68 and 72. More specifically, front and rear rollers 66 and 68, respectively, and guide assembly channel 56 remain substantially aligned, and front and rear rollers 70 and 72, respectively, and guide assembly channel 58 remain substantially aligned during movement of rack 38 when rack centerline 52 is skewed relative to rack assembly centerline 32.

Mounting system 42 also includes a right front bracket arm (not shown in FIG. 1), a right rear bracket arm (not shown in FIG. 1), a left front bracket arm (not shown in FIG. 1), and a left rear bracket arm (not shown in FIG. 1). The right front bracket arm and the right rear bracket arm are coupled to rollers 66 and 68, respectively, and are slidably mounted to axle 80. The left front bracket arm and the left rear bracket arm are secured to rollers 70 and 72, respectively, and are slidably mounted to axle 82.

In operation, rack 38 is positioned within wash chamber 22 and is slidable relative to tub 20 such that rack 38 can be slidably withdrawn or re-inserted within wash chamber 22. When rack centerline 52 is substantially aligned with rack assembly centerline 32, inducing a pushing or pulling force to rack 38 along rack centerline 52 causes rack 38 to move respectively inwardly or outwardly relative to wash chamber 22. More specifically, because the force is induced along rack centerline 52 and because the rack centerline 52 is substantially aligned with rack assembly centerline 32, rollers 66, 68, 70 and 72 remain substantially aligned with guide assembly channels 56 and 58.

If, however, rack centerline 52 is not aligned with rack assembly centerline 32 and a pushing or pulling force is induced to rack 38 or when rack centerline 52 is aligned with rack assembly centerline 32 and a pushing or pulling force is induced to rack 38 along a line other than rack centerline 52, mounting system 42, which is coupled to rack 38, slidably moves relative to roller assembly 40 such that rollers 66 and 68 remain substantially aligned with guide assembly channel 56, and rollers 70 and 72 remain substantially aligned with guide assembly channel 58. Thus, the present invention facilitates a reduction in binding between rollers 66, 68, 70 and 72 and guide assembly channels 56 and 58, and facilitates the movement of rack 38 relative to wash chamber 22 without significantly increasing the amount of force required to be induced to rack 38 for opening and closing rack 38.

In addition, guide assembly channels 56 and 58 may be formed from rolled steel. Sharp steel edges are sometimes created along the inside of guide assembly channels 56 and 58 from the forming process if rack 38 were to become skewed, rollers 66, 68, 70 and 72 may catch or bind on the sharp steel edges along the inside of guide assembly channels 56 and 58. In the exemplary embodiment, mounting system 42 slidably moves relative to roller assembly 40 such that rollers 66, 68, 70 and 72 remain substantially aligned with guide assembly channels 56 and 58, facilitating a reduction in the likelihood of binding between rollers 66, 68, 70 and 72 and the sharp steel edges that may exist along the inside of guide assembly channels 56 and 58.

Figure 2:
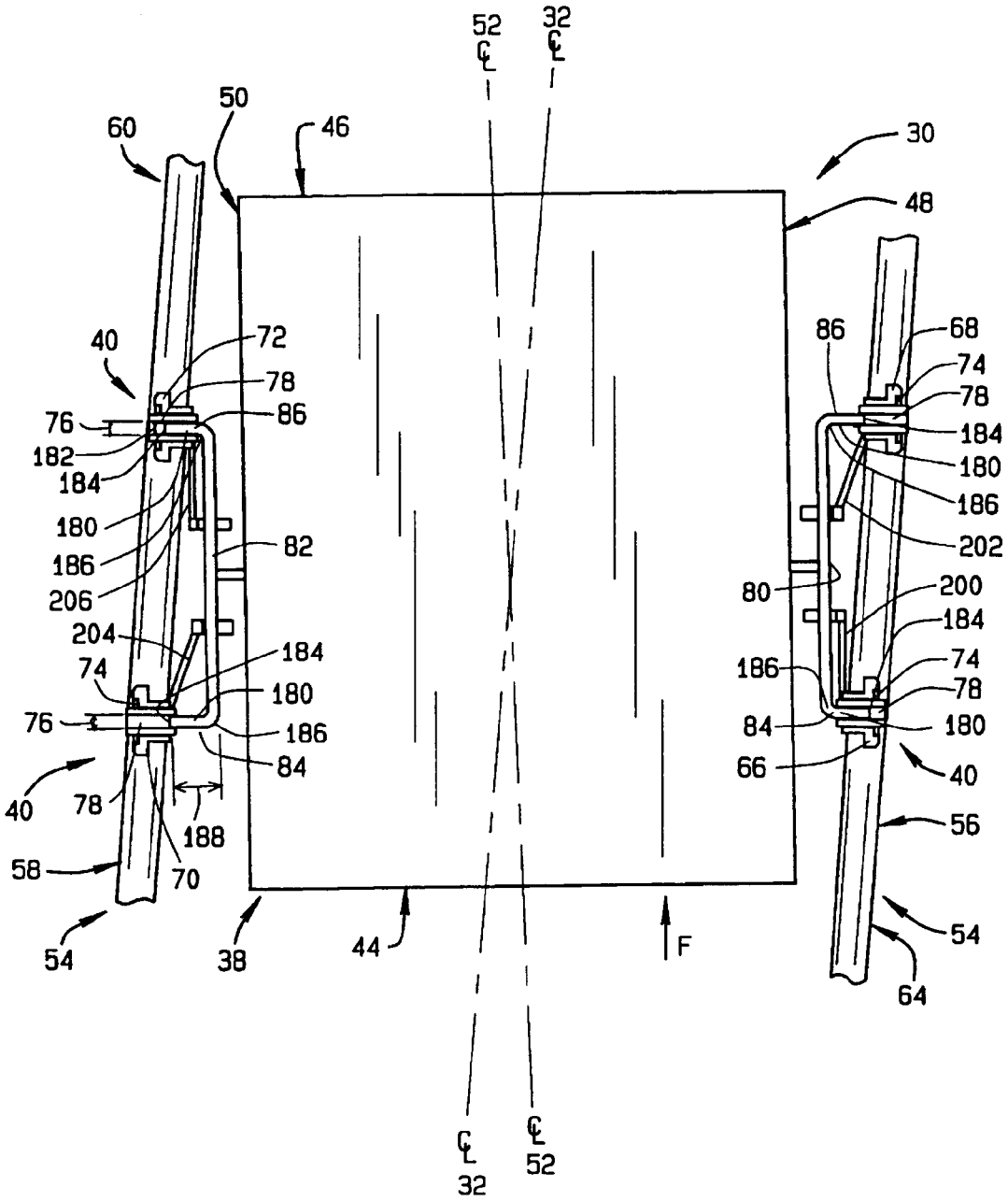
FIG. 2 is a plan view of the upper rack assembly shown in FIG. 1 and including a rack in a skewed position.

FIG. 2 is a plan view of upper rack assembly 30 shown in FIG. 1 and including rack centerline 52 skewed relative to rack assembly centerline 32. Upper rack 38 has front edge 44, rear edge 46, right side edge 48, left side edge 50, and centerline 52. Rack front and rear edges 44 and 46, respectively, are connected by rack right and left side edges 48 and 50, respectively. Rack centerline 52 extends from rack front edge 44 to rack rear edge 46.

Roller assembly 40 rotatably couples rack 38 to guide assembly 54 mounted within dishwasher 10. More specifically, rack 38 is slidably moveable with respect to wash chamber 22 (not shown in FIG. 2) by roller assembly 40. Guide assembly 54 includes guide assembly channel 56 secured to right tub sidewall 24 (not shown in FIG. 2) and guide assembly channel 58 secured to left tub sidewall 26 (not shown in FIG. 2). Each channel member 56 and 58 includes body portion 60, and upper and lower projecting flange portions 62 and 64, respectively. Upper flange portion 62 and lower flange portion 64 project from body portion 60, and converge towards each other. Roller assembly 40 includes right front roller 66, right rear roller 68, left front roller 70, and left rear roller 72. Right front roller 66 and right rear roller 68 are positioned within guide assembly channel 56 and are substantially aligned with guide assembly channel 56. Left front roller 70 and left rear roller 72 are positioned within guide assembly channel 58 and are substantially aligned with guide assembly channel 58. Each roller 66, 68, 70, and 72 has hub 74 that has diameter 76 and bore 78 extending therethrough.

Mounting system 42 includes axle 80 that is coupled to rack right side edge 48 and extends substantially parallel to rack right side edge 48, and axle 82 that is coupled to rack left side edge 50 and extends substantially parallel to rack left side edge 50. Each axle 80 and 82 has front slide 84 and rear slide 86. Each front slide 84 extends from each respective axle 80 and 82, and slidably couples to respective front rollers 66 and 70, and each rear slide 86 extends from each respective axle 80 and 82, and slidably couples to respective rear rollers 68 and 72. More specifically, each front and rear slide 84 and 86, respectively, includes a slide rod 180 that has a diameter 182, a first end 184, and a second end 186 adjacent to each respective axle 80 and 82. Slide rod diameter 182 is less than roller hub diameter 76. Each slide rod 180 extends from each respective axle 80 and 82 into respective roller 66, 68, 70 and 72. Each slide rod 180 is slidably moveable within roller hub bore 78 such that front and rear rollers 66 and 68, respectively, and guide assembly channel 56 remain substantially aligned, and front and rear rollers 70 and 72, respectively, and guide assembly channel 58 remain substantially aligned during movement of rack 38 when rack centerline 52 is skewed relative to rack assembly centerline 32.

In addition, slide rod 180 has a length 188 extending between slide rod first end 184 and slide rod second end 186. Slide rod length 188 is selected such that a portion of each slide rod 180 remains within roller hub bore 74 during movement of rack 38 when rack centerline 52 is skewed relative to rack assembly centerline 32.

Mounting system 42 also includes a right front bracket arm 200, a right rear bracket arm 202, a left front bracket arm 204, and left rear bracket arm 206. Bracket arms 200 and 202 are coupled to rollers 66 and 68, respectively, and are slidably coupled to axle 80. Bracket arms 204 and 206 are coupled to rollers 70 and 72, respectively, and are slidably coupled to axle 82. Bracket arms 200, 202, 204 and 206 are resiliently flexible such that bracket arms 200, 202, 204 and 206 can flex during movement of rack 38 when rack centerline 52 is skewed relative to rack assembly centerline 32.

In operation, rack 38 is positioned within wash chamber 22 and slidable relative to tub 20 so that rack 38 can be slidably withdrawn or re-inserted within wash chamber 22. When rack centerline 52 is not aligned with rack assembly centerline 32 and a pushing or pulling force F is induced to rack 38, each slide rod 180 slidably moves within roller hub bore 78 while bracket arms 200 and 202 slidably move along axle 80 and bracket arms 204 and 206 slidably move along axle 82 such that rollers 66 and 68 remain substantially aligned with guide assembly channel 56, and rollers 70 and 72 remain substantially aligned with guide assembly channel 58. Thus, the rack assembly described herein facilitates a reduction in binding between rollers 66, 68, 70 and 72 and respective guide assembly channels 56 and 58, and facilitates the movement of rack 38 relative to wash chamber 22 without significantly increasing the amount of force F required to be induced to rack 38 to move rack 38.

Figure 3:
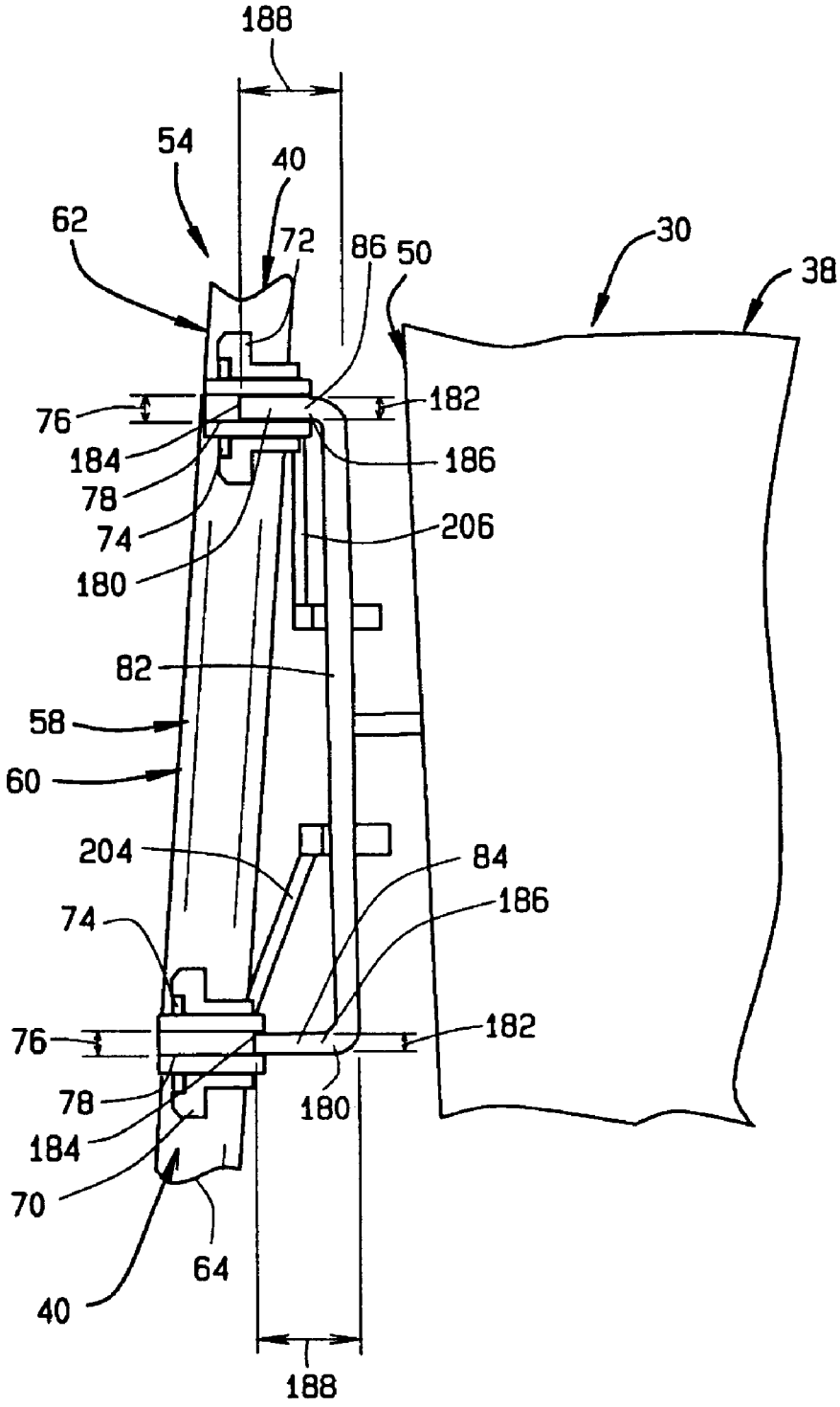
FIG. 3 is a partial plan view of the upper rack assembly shown in FIG. 1 and including a rack in a skewed position

FIG. 3 is a partial plan view of upper rack assembly 30 shown in FIG. 1 and including a rack 38 in a skewed position. Upper rack 38 has front edge 44 (not shown in FIG. 3), rear edge 46 (not shown in FIG. 3), right side edge 48 (not shown in FIG. 3), and left side edge 50.

Roller assembly 40 rotatably couples rack 38 to guide assembly 54 within dishwasher 10 (not shown in FIG. 3). More specifically, rack 38 is slidably moveable with respect to wash chamber 22 (not shown in FIG. 3) by roller assembly 40. Guide assembly 54 includes guide assembly channel 56 (not shown in FIG. 3) secured to right tub sidewall 24 (not shown in FIG. 3) and guide assembly channel 58 secured to left tub sidewall 26 (not shown in FIG. 3). Each channel member 56 and 58 includes body portion 60, and upper and lower projecting flange portions 62 and 64, respectively. Upper flange portion 62 and lower flange portion 64 project from body portion 60 and converge towards each other. Roller assembly 40 includes right front roller 66 (not shown in FIG. 3), right rear roller 68 (not shown in FIG. 3), left front roller 70, and left rear roller 72. Rollers 70 and 72 are positioned within guide assembly channel 58 and are substantially aligned with guide assembly channel 58. Each respective roller 66, 68, 70, and 72 has a hub 74 that has a diameter 76 and a bore 78 extending therethrough. In the exemplary embodiment, each bore 78 is substantially smooth.

Mounting system 42 includes axle 80 (not shown in FIG. 3) that is coupled to rack right side edge 48, and axle 82 that is coupled to rack left side edge 50. Each axle 80 and 82 has front slide 84 and rear slide 86. Front slide 84 extends from axle 82 and slidably couples to front roller 70, and rear slide 86 extends from axle 82 and slidably couples to rear roller 72. More specifically, each slide 84 and 86 includes a slide rod 180 having a diameter 182, a first end 184, and a second end 186 adjacent to axle 82. Slide rod diameter 182 is less than roller hub diameter 76. Each slide rod 180 extends from each respective axle 80 and 82 into respective roller 66, 68, 70 and 72. Each slide rod 180 is slidably moveable within roller hub bore 78 such that front and rear rollers 66 and 68, respectively, and guide assembly channel 56 remain substantially aligned, and front and rear rollers 70 and 72, respectively, and guide assembly channel 58 remain substantially aligned during movement of rack 38 when rack centerline 52 is skewed relative to rack assembly centerline 32.

In addition, slide rod 180 has a length 188 extending between slide rod first end 184 and slide rod second end 186. Slide rod length 188 is selected such that a portion of each slide rod 180 remains within roller hub bore 78 during movement of rack 38 when rack centerline 52 is skewed relative to rack assembly centerline 32.

Mounting system 42 also includes right front bracket arm 200 (not shown in FIG. 3), right rear bracket arm 202 (not shown in FIG. 3), left front bracket arm 204, and left rear bracket arm 206. Bracket arms 200 and 202, respectively, are coupled to rollers 66 (not shown in FIG. 3) and 68 (not shown in FIG. 3), respectively, and are slidably coupled to axle 80 (not shown in FIG. 3). Bracket arms 204 and 206, respectively, are coupled to rollers 70 and 72, respectively, and are slidably coupled to axle 82. Bracket arms 200, 202, 204 and 206 are resiliently flexible such that bracket arms 200, 202, 204 and 206 can flex during movement of rack 38 when rack centerline 52 is skewed relative to rack assembly centerline 32.

In operation, rack 38 is positioned within wash chamber 22 and slidable relative to tub 20 so that rack 38 can be slidably withdrawn or re-inserted within wash chamber 22. When rack centerline 52 is not aligned with rack assembly centerline 32 and a pushing or pulling force F is induced to rack 38, each slide rod 180 slidably moves within roller hub bore 78 while bracket arms 200 and 202 slidably move along axle 80 and bracket arms 204 and 206 slidably move along axle 82 such that rollers 66 and 68 remain substantially aligned with guide assembly channel 56, and rollers 70 and 72 remain substantially aligned with guide assembly channel 58. Thus, the rack assembly described herein facilitates a reduction in binding between rollers 66, 68, 70 and 72 and respective guide assembly channels 56 and 58, and facilitates the movement of rack 38 relative to wash chamber 22 without significantly increasing the amount of force F required to be induced to rack 38 to move rack 38.

In at least some known dishwashers, the upper racks are slidably coupled to the dishwasher such that the upper racks are moveable with respect to the wash chamber. The upper racks are attached to rollers which are positioned within guide assemblies which define the fixed line of movement of the rack. The guide assemblies include clearances to facilitate free movement of the rollers. These clearances, however, may cause looseness between the rollers and the guide assemblies, and may facilitate the rack becoming skewed during the movement of the rack. The rack assembly described herein includes a mounting system that is slidably coupled to a roller assembly such that when the rack is skewed during the movement of the rack each roller remains aligned with the guide assembly. Thus, the rack assembly described herein facilitates a reduction in the relatively tight frictional drag between the rollers and the guide assemblies which may cause binding between the rollers and the guide assemblies, and facilitates the movement of the rack relative to the wash chamber without significantly increasing the amount of force required to be induced to rack to move the rack.

While the invention has been described in terms of various specific embodiments, those skilled in the art will recognize that the invention can be practiced with modification within the spirit and scope of the claims.

What is claimed is:

1. A rack assembly for a dishwasher, said rack assembly having a centerline extending from a front of the dishwasher to a rear of the dishwasher, said rack assembly comprising:

a rack comprising a front edge and a rear edge connected by a right side edge and a left side edge, said rack having a centerline extending from said rack front edge to said rack rear edge;

a roller assembly rotatably coupling said rack to the dishwasher such that said rack is slidably moveable with respect to the dishwasher; and a mounting system coupled to said rack and slidably coupled to said roller assembly, said mounting system configured to remain coupled to said roller assembly during movement of said rack when said rack centerline is skewed relative to said rack assembly centerline.

2. A rack assembly in accordance with claim 1 further comprising a guide assembly coupled between the dishwasher and said mounting system.

3. A rack assembly in accordance with claim 2 wherein said guide assembly comprises an elongated channel member comprising a body portion and upper and lower flange portions, said upper and lower flange portions projecting from said body portion and converging towards each other.

4. A rack assembly in accordance with claim 1 wherein said roller assembly comprises a front roller positioned in close proximity to said rack front edge, and a rear roller positioned in close proximity to said rack rear edge, said front roller substantially aligned with respect to said rear roller.

5. A rack assembly in accordance with claim 4 wherein said front roller rotatably couples said rack to said guide assembly, said rear roller rotatably couples said rack to said guide assembly, said front and rear rollers substantially aligned with respect to said guide assembly.

6. A rack assembly in accordance with claim 5 wherein each said roller comprises a hub comprising a bore extending therethrough.

7. A rack assembly in accordance with claim 6 wherein said mounting system comprises at least one axle, a front slide, and a rear slide, said axle coupled to at least one of said rack left and right side edge and extending substantially parallel to said rack side edges, said front slide extending from said axle in close proximity to said rack front edge and slidably coupled to said front roller, and said rear slide extending from said axle in close proximity to said rack rear edge and slidably coupled to said rear roller, said front and rear rollers and said guide assembly configured to remain substantially aligned during movement of said rack when said rack centerline is skewed relative to said rack assembly centerline.

8. A rack assembly in accordance with claim 7 wherein said roller bore has a diameter, said mounting system slide comprises a slide rod having a diameter less than said roller hub bore diameter, said slide rod further comprising a first end and a second end adjacent said axle, said slide rod extending from said axle into said hub bore, said slide rod slidably moveable within said hub bore such that said front and rear rollers and said guide assembly remain substantially aligned during movement of said rack when said rack centerline is skewed relative to said rack assembly centerline.

9. A rack assembly in accordance with claim 8 wherein said slide rod further comprises a length extending between said slide rod first and second ends, said length selected such that a portion of said slide rod remains within said roller hub bore during movement of said rack when said rack centerline is skewed relative to said rack assembly centerline.

10. A rack assembly in accordance with claim 8 wherein said mounting system further comprises a front bracket arm and a rear bracket arm, said front bracket arm comprising a roller end, an axle end, and a body extending therebetween, said front bracket arm roller end coupled to said front roller and said front bracket arm axle end slidably coupled to said axle, said rear bracket arm comprising a roller end, an axle end, and a body extending therebetween, said rear bracket arm roller end coupled to said rear roller and said rear bracket arm axle end slidably coupled to said axle.

11. A rack assembly in accordance with claim 10 wherein said front and rear bracket arms slidably coupled to said axle such that said front and rear rollers and said guide assembly remain substantially aligned when said slide rods slidably move relative to said rollers during movement of said rack when said rack centerline is skewed relative to said rack assembly centerline.

12. A rack assembly in accordance with claim 1 wherein said mounting system comprises at least one axle, a front slide, and a rear slide, said axle coupled to at least one of said rack left and right side edge and extending substantially parallel to said rack side edges, said front slide extending from said axle in close proximity to said rack front edge and slidably coupled to said front roller, and said rear slide extending from said axle in close proximity to said rack rear edge and slidably coupled to said rear roller, said front and rear rollers and said guide assembly configured to remain substantially aligned during movement of said rack when said rack centerline is skewed relative to said rack assembly centerline.

13. A rack assembly in accordance with claim 12 wherein said mounting system further comprises at least one bracket arm, said bracket arm comprising a roller end mounted to said roller assembly, an axle end slidably mounted to said axle, and a body section extending therebetween.

14. A dishwasher comprising:

a cabinet comprising an access door comprising an upper end and a lower end, said lower end hinged such that said door pivots on a substantially horizontal axis to open outwardly from said cabinet;

a tub positioned within said cabinet and forming a wash chamber, said tub comprising right and left sidewalls;

a guide assembly coupled to said right and left sidewalls; and at least one rack assembly positioned within said wash chamber and moveable relative to said tub, said rack assembly having a centerline extending from a front of said dishwasher to a rear of said dishwasher, said rack assembly comprising:

a rack comprising a front edge, a rear edge, a right side edge, a left side edge, and a centerline, said front and rear edges connected by said left and right side edges, said right side edge adjacent said right tub sidewall, said left side edge adjacent said left tub sidewall, said rack having a centerline extending from said rack front edge to said rack rear edge;

a roller assembly rotatably coupling said rack to said guide assembly such that said rack is slidably moveable with respect to said wash chamber; and a mounting system coupled to said rack and slidably coupled to said roller assembly, said mounting system configured to remain coupled to said roller assembly during movement of said rack when said rack centerline is skewed relative to said rack assembly centerline.

15. A dishwasher in accordance with claim 14 wherein each said guide assembly comprises an elongated channel member coupled to at least one of said right and left sidewall, each said channel member comprises a body portion, and upper and lower projecting flange portions, said upper and lower flange portions projecting from said body portion and converging towards each other.

16. A dishwasher in accordance with claim 15 wherein said roller assembly comprises a pair of front rollers coupled to said rack right and left side edges in close proximity to said rack front edge, and a pair of rear rollers coupled to said rack right and left side edges in close proximity to said rack rear edge, said front and rear rollers substantially aligned within said guide assembly channel member.

17. A dishwasher in accordance with claim 16 wherein each said roller comprises a hub comprising a bore extending therethrough.

18. A dishwasher in accordance with claim 17 wherein said mounting system comprises a pair of axles coupled to said rack side edges and extending substantially parallel to said rack side edges, each axle comprising a front slide in close proximity to said rack front edge and a rear slide in close proximity to said rack rear edge, each said front slide extending from said axle and slidably coupled to each said front roller, each said rear slides extending from said axle and slidably coupled to each said rear roller such that said front and rear rollers and said guide assembly remain substantially aligned during movement of said rack when said rack centerline is skewed relative to said rack assembly centerline.

19. A dishwasher in accordance with claim 18 wherein each said roller bore has a diameter, said mounting system slide comprises a slide rod, a first end, and a second end adjacent said axle, said rod diameter less than said roller bore diameter, said slide rod extending from said axle into said hub bore, said slide rod is slidably moveable within said hub bore such that said front and rear rollers and said guide assembly remain substantially aligned during movement of said rack when said rack centerline is skewed relative to said rack assembly centerline.

20. A dishwasher in accordance with claim 19 wherein said slide rod further comprises a length extending between said slide rod first and second ends, said length selected such that a portion of each said slide rod remains within said roller hub bore during movement of said rack when said rack centerline is skewed relative to said rack assembly centerline.

21. A dishwasher in accordance with claim 19 wherein said mounting system further comprises a pair of front bracket arms and a pair of rear bracket arms, each said front and rear bracket arm comprising a roller end, an axle end, and a body extending therebetween, each said front bracket arm roller end coupled to said front roller and each said front bracket arm axle end slidably coupled to said axle, each said rear bracket arm roller end coupled to said rear roller and each said rear bracket arm axle end slidably coupled to said axle.

22. A dishwasher in accordance with claim 21 wherein each said front and rear bracket arm slidably coupled to said axles such that said front and rear rollers and said guide assembly remain substantially aligned when said slide rods slidably move relative to said rollers during movement of said rack when said rack centerline is skewed relative to said rack assembly centerline.

23. A dishwasher assembly in accordance with claim 14 wherein said mounting system comprises a pair of axles coupled to said rack side edges and extending substantially parallel to said rack side edges, each axle comprising a front slide in close proximity to said rack front edge and a rear slide in close proximity to said rack rear edge, each said front slide extending from said axle and slidably coupled to said roller assembly, each said rear slide extending from said axle and slidably coupled to said roller assembly such that said mounting system remains coupled to said roller assembly during movement of said rack when said rack centerline is skewed relative to said rack assembly centerline.

24. A dishwasher in accordance with claim 23 wherein said mounting system further comprises a pair of bracket arms coupled to each said axle, each said bracket arm comprising a roller end mounted to said roller assembly, an axle end slidably mounted to said axle, and a body section extending therebetween.

25. A method for assembling a rack assembly for a dishwasher, the rack assembly having a centerline extending from a front of the dishwasher to a rear of the dishwasher, said method comprising:

providing a rack including a front edge and a rear edge connected by a right side edge and a left side edge wherein the rack has a centerline that extends from the rack front edge to the rack rear edge;

coupling a roller assembly to the rack;

coupling a mounting system to the rack and to the roller assembly; and rotatably coupling the roller assembly to the dishwasher such that the rack is moveable with respect to the dishwasher and such that the mounting system remains slidably coupled to the roller assembly during movement of the rack when the rack centerline is skewed relative to the rack assembly centerline.

26. A method in accordance with claim 25 further comprising coupling a guide assembly between the dishwasher and the mounting system.

27. A method in accordance with claim 26 wherein coupling a guide assembly further comprises coupling a guide assembly including an elongated channel member having a body portion and upper and lower projecting flange portions to the mounting system such that the upper and lower flange portions project from the body portion and converge towards each other.

28. A method in accordance with claim 25 wherein coupling a roller assembly further comprises coupling a roller assembly to the rack where the roller assembly includes a front roller in close proximity to the rack front edge and a rear roller in close proximity to the rack rear edge, and positioned such that the front roller is substantially aligned with the rear roller.

29. A method in accordance with claim 28 wherein coupling a roller assembly further comprises coupling a roller assembly to the rack that includes front and rear rollers that rotatably couple the rack to the guide assembly.

30. A method in accordance with claim 29 wherein coupling a roller assembly further comprises coupling a roller assembly to the rack such that each of the rollers includes a hub having a diameter and a bore extending therethrough.

31. A method in accordance with claim 30 wherein coupling a mounting system further comprises coupling a mounting system to the rack that includes at least one axle, a front slide, and a rear slide, the axle is coupled to the rack side edge and extends substantially parallel to the rack side edge, the front slide extends from the axle in close proximity to the rack front edge and slidably couples to the front roller, the rear slide extends from the axle in close proximity to the rack rear edge and slidably couples to the rear roller such that the front and rear rollers and the guide assembly remain substantially aligned during movement of the rack when the rack centerline is skewed relative to the rack assembly centerline.

32. A method in accordance with claim 31 wherein coupling a mounting system further comprises coupling a mounting system to the rack wherein the slide includes a slide rod having a diameter less than the roller hub bore diameter, a first end, and a second end adjacent said axle, the slide rod extends from the axle into the hub bore and is slidably moveable within the hub bore such that the front and rear rollers and the guide assembly remain substantially aligned during movement of the rack when the rack centerline is skewed relative to the rack assembly centerline.

33. A method in accordance with claim 32 wherein coupling a mounting system further comprises coupling a mounting system wherein the slide rod has a length extending between the slide rod first and second ends, said length selected such that a portion of the slide rod remains within the roller hub bore during movement of the rack when the rack centerline is skewed relative to the rack assembly centerline.

34. A method in accordance with claim 32 wherein coupling a mounting system further comprises coupling a mounting system including a front bracket arm and a rear bracket arm, the front bracket arm has a roller end coupled to the front roller, an axle end slidably coupled to the axle, and a body extending therebetween, the rear bracket arm has a roller end coupled to the rear roller, an axle end slidably coupled to the axle, and a body extending therebetween.

35. A method in accordance with claim 34 wherein coupling a mounting system further comprises coupling a mounting system that includes the front and rear bracket arms slidably coupled to the axle such that the front and rear rollers and the guide assembly remain substantially aligned when the slide rods slidably move relative to the rollers during movement of the rack when the rack centerline is skewed relative to the rack assembly centerline.

* * * * *